United States Patent [19]

Arai

[11] Patent Number: 4,895,495

[45] Date of Patent: Jan. 23, 1990

[54] ELECTROMAGNETIC PUMP WITH PROJECTIONS FORMED ON THE COIL BOBBIN

[75] Inventor: Takatoshi Arai, Saitama, Japan

[73] Assignee: Jidosha Kiki Co., Ltd., Tokyo, Japan

[21] Appl. No.: 287,911

[22] Filed: Dec. 21, 1988

[30] Foreign Application Priority Data

Dec. 25, 1987 [JP] Japan ..... 62-196007

[51] Int. Cl.[4] ..... F04B 17/04

[52] U.S. Cl. ..... 417/360; 417/417; 310/15

[58] Field of Search ..... 417/360, 416, 417, 418, 417/552–554; 310/15, 23, 30; 123/497, 499

[56] References Cited

U.S. PATENT DOCUMENTS 4,314,797 2/1982 Gerwin ..... 417/566 X
4,643,653 2/1987 Masaka et al. ..... 417/417
4,661,048 4/1987 Masaka et al. ..... 417/417 X
4,778,357 10/1988 Arai et al. ..... 417/417

FOREIGN PATENT DOCUMENTS 2755387 6/1978 Fed. Rep. of Germany ..... 417/417
61-70581 5/1986 Japan .

*Primary Examiner*—Leonard E. Smith
*Assistant Examiner*—Eugene L. Szczecina, Jr.
*Attorney, Agent, or Firm*—Blakely, Sokoloff, Taylor & Zafman

[57] ABSTRACT

An electromagnetic pump includes a cylindrical member, a resin coil bobbin, a printed circuit board, a holder, and pump housing. Engaging projections are formed on a peripheral portion of a surface of the coil bobbin, which opposes the lid, and the electromagnetic pump components are held in the pump housing while they are biased in the axial direction of the cylindrical member by utilizing the engaging projections.

1 Claim, 2 Drawing Sheets

ELECTROMAGNETIC PUMP WITH PROJECTIONS FORMED ON THE COIL BOBBIN

BACKGROUND OF THE INVENTION

The present invention relates to an improvement of an electromagnetic pump used for, e.g., supplying fuel to a vehicle.

A demand has arisen for an electromagnetic pump used as a vehicle fuel supply pump, which has a simple structure and can perform a stable pump operation without requiring high working and assembly precision of each component. Conventional electromagnetic pumps of this type, however, have their own advantages and disadvantages. A pump which can satisfy all the above characteristics has not been realized yet.

Cylindrical and square type pumps are generaly known as the conventional electromagnetic pumps of this type. The cylindrical type pump is designed such that a sleeve member for housing a plunger is arranged in a cylindrical housing, suction and delivery chambers are formed at both the ends of the sleeve member, and an electric chamber in which an excitation coil, a transistor, a printed circuit board, and the like are arranged is formed in a central portion of the sleeve member. The square type pump is designed such that a sleeve member for housing a plunger is arranged in a square housing, which is formed by assembling housing members each having a substantially U-shaped sectional area, so as to extend therethrough, and an excitation coil and the like are housed in the housing. However, each of the electromagnetic pumps having these conventional structures has a complicated structure and a large number of components, thereby posing problems in terms of working and assembly. In addition, a serious problem is posed when a decrease in size, weight, and cost of the overall pump is attempted. Therefore, some countermeasures must be taken.

The present inventors, therefore, reviewed the overall conventional pump structures described above, and proposed a simple electromagnetic pump in Japanese Utility Model Laid Open No. 61-70581 and the like. According to this electromagnetic pump, an arrangement of each portion is simplified, the number of components is decreased, working and assembly of each portion can be facilitated, and reliability of the operation can be increased, while a decrease in size, weight, and cost of the overall pump can be realized. More specifically, this simple electromagnetic pump is designed such that a pump housing is constituted by a substantially cup-like housing body and a lid for sealing an opening end of the housing body, and a resin coil bobbin arranged around a sleeve member for housing a plunger and used for winding an excitation coil, a printed circuit board stacked on the outer surface of one flange at a predetermined distance and used for mounting various electronic parts including a transistor, and a holder and the like stacked outward therefrom at a predetermined distance are sequentially stacked and housed in the pump housing, while the stacked components are biased toward the lid side by a leaf spring inserted in a bottom side of the housing body, thereby canceling variations in size of these components in the housing and obtaining a stable assembly state.

According to the structure of the simple pump described above, however, problems are still posed in an assembly process wherein the components such as the holder, the printed circuit board, and the coil bobbin including the leaf spring are sequentially stacked and incorporated in the housing body from the bottom side, the opening end is sealed by the lid, and the lid and housing body are integrally formed by caulking or the like. Therefore it leaves much room for improvement. More specifically, the simple pump of their type, it is required that a sleeve member for housing a plunger, a pair of magnetic cylinders constituting a magnetic circuit, which are fitted in both end portions of the sleeve member and adapted to reciprocate the plunger, and a sealing ring and the like which are arranged between these magnetic cylinders or the outer end sides of these cylinders so as to seal fluid paths constituted by the sleeve member and the like are housed and arranged in the housing body in addition to the above-described components. In the conventional pump structures, the sleeve member and the like are sequentially incorporated in the housing, the coil bobbin and the like are then stacked and housed, and the lid is mounted and fixed on the housing by caulking. In this case, the laminated body of the coil bobbin and the like is assembled while the leaf spring is compressed. When the lid is mounted on the housing, the components are moved toward the lid side due to the reaction force of the leaf spring, and are stably arranged in the pump housing. Note that the sleeve member is in a state wherein it can be integrally moved with the inner wall of the coil bobbin due to the friction of the seal ring interposed between the magnetic cylinders. Therefore, the sleeve member is also moved toward the lid side upon movement of the coil bobbin and the like toward the lid side. If the sleeve member is moved in this manner, the seal ring, which is interposed in the bottom side of the housing body so as to seal the bottom side, may be slipped off from the end portion of the sleeve member, so that the seal ring protrudes into the sleeve member or a compression force for providing a seal in the axial direction cannot be ensured. As a result, problems such as degradation in a sealing function at this portion are posed.

Since such problems occur especially in the caulking process of the lid, a test and the like are difficult to perform. Furthermore, since a repair of that portion must be performed by disassembling the overall housing, a serious problem is posed also in terms of assembly. Therefore, some countermeasures must be taken to realize a stable pump performance in consideration of these problems.

SUMMARY OF THE INVENTION

It is, therefore, an object of the present invention to provide an electromagnetic pump which has a simple arrangement and can greatly reduce the cost.

It is another object of the present invention to provide an electromagnetic pump which can prevent problems such as slipping of a sealing ring and ensure reliability as a pump.

According to the present invention, a laminated body constituted by a holder, a printed circuit board, a coil bobbin, and the like is housed in a housing body, and a lid is mounted and fixed on an opening end of the housing body by caulking or the like, thereby constituting a pump housing. With this arrangement, the laminated body is properly arranged and held in the housing by utilizing a biasing force due to deformation of a flange through engaging projections formed on the coil bobbin side. Accordingly, this arrangement can prevent movement of the laminated body in the housing as in the conventional pump and hence prevent degradation in sealing performance and the like.

DETAILED DESCRIPTION OF THE PREFERRED EMBODIMENT

A preferred embodiment of the present invention will be described in detail below with reference to the accompanying drawings.

Figure 1:
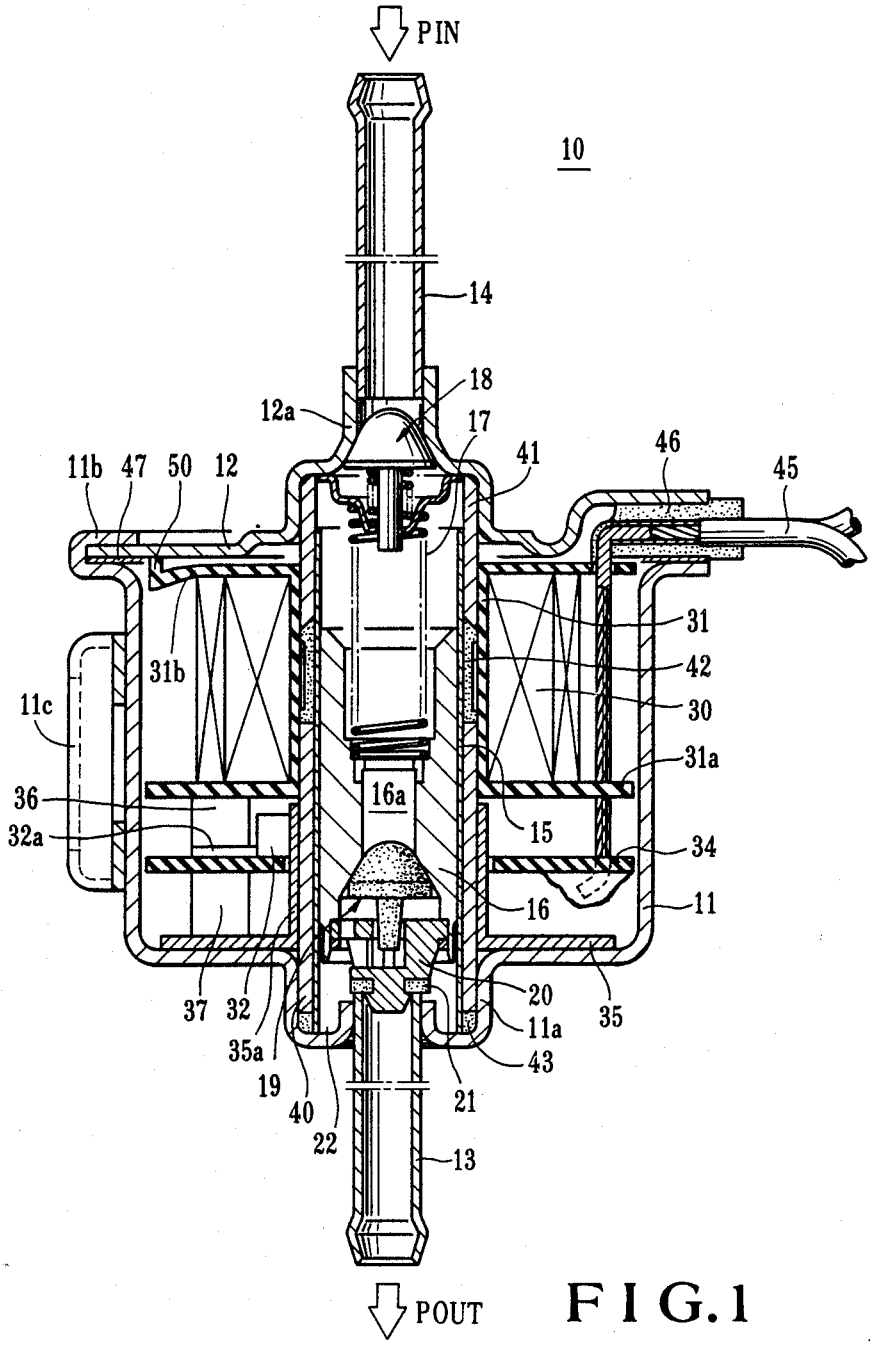
FIG. 1 is a longitudinal section view showing an electromagnetic pump according to an embodiment of the present invention.

FIG. 1 shows an electromagnetic pump according to an embodiment of the present invention. A schematic arrangement of an electromagnetic pump 10 will be briefly described with reference to FIG. 1. Reference numeral 11 denotes a cup-like housing body constituting a pump housing; and 12, a disk-like lid for closing an opening end of the housing body 11. Cylindrical portions 11*a* and 12*a* which expand outward are integrally formed at the central bottom portion of the body 11 and the central portion of the lid 12, respectively. Pipes 13 and 14 which serve as fluid outlet and inlet ports are fixed to the centers of the cylindrical portions 11*a* and 12*a* by brazing or the like. The body 11 and the lid 12 can be easily prepared by pressing a metal plate. An opening edge 11*b* of the body 11 is caulked so that the body 11 and the lid 12 constitute a single vessel. The housing body 11 and the lid 12 also serve as a yoke for forming a magnetic flux path from an excitation coil (to be described later). An internal space defined by the body 11 and the lid 12 is used to accommodate mechanical and electrical components of the pump. Reference numeral 11*c* denotes a mounting bracket for fixing the pump 10 to a mounting portion such as a vehicle body.

Reference numeral 15 denotes a nonmagnetic sleeve member interposed between the cylindrical portions 11*a* and 12*a* of the body 11 and the lid 12. A magnetic plunger 16 having a through hole 16*a* is slidably fitted inside the nonmagnetic sleeve member 15. In a normal state, the magnetic plunger 16 is urged toward the outlet port by a biasing force of a return spring 17 at the inlet port side. Reference numeral 18 denotes a suction valve arranged near the inlet end of the sleeve member 15. Reference numeral 19 denotes a delivery valve arranged near the outlet end of the plunger 16. A valve body constituting the delivery valve 19 is slidably supported in a central cylindrical portion of a ring-like member 20 constituting a control valve for preventing fluid leakage. In this case, the control valve is integrally fixed to the outlet end of the plunger 16. The ring-like member 20 also serves as a guide for guiding the valve body of the delivery valve 19. A valve seat 21 made of a rubber or synthetic resin material is mounted at the distal end portion of the cylindrical portion on the fluid outlet port. The valve seat 21 has a predetermined length within the end portion of the sleeve member 15 on the fluid outlet port side and serves to open/close the inner end of the fluid outlet port pipe 13. The fluid leakage preventing control valve is moved in the sleeve member 15 upon movement of the plunger 16. In the deenergization state, the valve closes the inner end of the pipe 13 by an action of the return spring 17, thereby reliably preventing the fluid from leaking toward the outlet port. In this embodiment, in order to constitute the control valve described above, the inner end of the pipe 13 of the outlet side is extended into the sleeve member 15 for a predetermined length, and an annular space 22 serving as a pulsation absorption chamber is formed around the extended portion.

Figure 3:
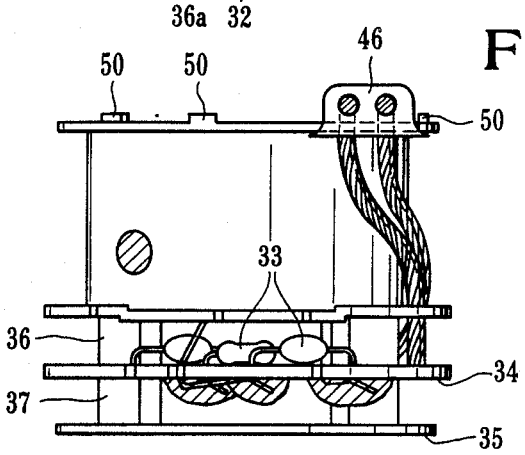
Figure 4:
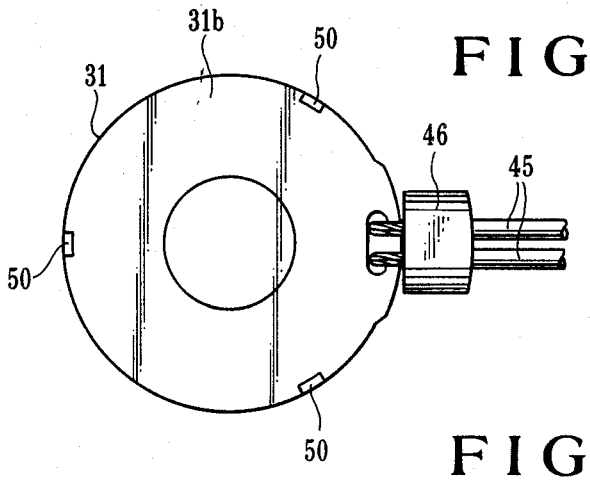
FIG. 4 is a plan view of the coil bobbin, showing engaging projections constituting a characteristic feature of the present invention.

A resin coil bobbin 31 around which an excitation coil 30 is wound is mounted around the sleeve member 15 which receives the plunger 16 therein. A printed circuit board 34 having a transistor 32 and various electronic components 33 (refer to FIG. 3) such as a resistor and a diode, all of which constitute an oscillator for supplying an intermittent current to the excitation coil 30, and a holder 35 for holding the circuit board 34 at a predetermined distance from the outer surface portion of one (lower) flange 31*a* are sequentially stacked on this flange surface in a direction perpendicular to the surface of the printed circuit board 34. A laminated body of the pump components is housed in the body 11 such that the holder 35 is located at the distal end of the housing body 11 while the laminated body is sandwiched between the body 11 and the lid 12 mounted thereon.

Figure 2:
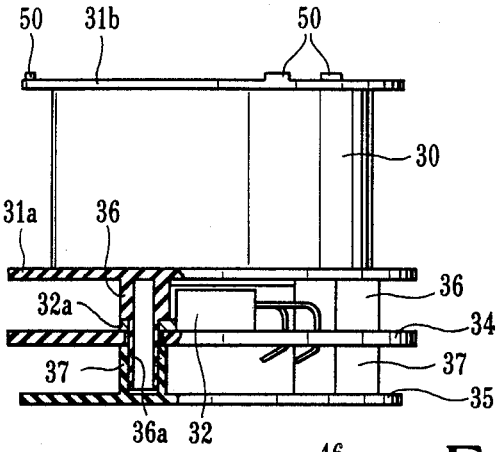
FIGS. 2 and 3 are schematic side views showing components to be assembled including a coil bobbin, which are stacked and housed in a pump housing.

As is apparent from FIG. 2, a plurality of studs 36 are integrally formed upright on the outer surface of the one flange 31*a* of the coil bobbin 31 so as to be engaged with the transistor 32 (mounting piece 32*a*) and support it with a predetermined distance between the transistor 32 and the outer surface and to support the printed circuit board 34 in the same manner. A plurality of studs 37 are formed upright on the inner surface of the holder 35 so as to oppose the studs 36. Note that reference numeral 36*a* denotes a small diameter portion at the distal end of the stud 36. The small-diameter portion 36*a* is fitted into the transistor 32 and further into a hole formed in the printed circuit board 34 so as to restrict movement of the transistor 32 and the printed circuit board 34 in their planar direction. In addition, the portion 36*a* is fitted into a hole formed in the stud 37 on the holder 35 side so as to constitute a laminated body. Reference numeral 35*a* denotes a cylindrical portion formed upright at the center of the holder 35. In this embodiment, the printed circuit board 34 and the holder 35 have substantially ring like shapes to match with the coil bobbin 31.

Reference numerals 40 and 41 denote magnetic cylinders inserted between the outer circumferential surface of the sleeve member 15 containing the plunger 16 therein and the inner wall surface of the bobbin 31 from both ends. The magnetic cylinders 40 and 41 are used to reciprocate the plunger 16 by an excitation force of the coil 30. In this case, the magnetic cylinder 41 on the lid 12 side is brazed at its entire outer surface simultaneously with brazing of the pipe 14 constituting a fluid inlet port such that the outer end portion of the magnetic cylinder 41 is fitted in the cylindrical portion 12*a* of the lid 12, thereby maintaining a good seal.

Reference numerals 42 and 43 denote seal materials for sealing a space between the interior of the sleeve member 15 and the internal space of the pump housing. Reference numeral 45 denotes a lead led from the excitation coil 30 through a connection portion between the housing body 11 and the lid 12, and a grommet 46. Reference numeral 47 denotes a gasket for sealing a space between the body 11 and the lid 12. Other arrangements and an operation and the like of the electromagnetic pump 10 are known, and hence a description thereof will be omitted.

According to the above-described arrangement, the transistor 32, the printed circuit board 34, and the holder 35 are sequentially mounted on the studs 36 formed upright on the outer surface of the one flange 31*a* of the coil bobbin 31. The respective components are stacked while proper intervals are kept from each other. In addition, the sleeve member 15 and the like are mounted in the housing body 11 in advance so as to extend through the central portion thereof, the lid 12 is mounted on the body 11, and the opening edge 11*b* of the body 11 is caulked to integrate the body 11 and lid 12, thereby assembling all the components.

According to the electromagnetic pump 10 having the above arrangement, a pump housing is constituted by the cup-like body 11 and the like for closing the opening end of the body 11, and the respective components are simply stacked and accommodated in the pump housing, so that an arrangement and working of each component can be simplified, and assembly and the like ca be facilitated. In addition, by incorporating the electric chamber components by effectively using a space (tends to become a dead space) defined above the coil bobbin 31, the size and weight of the overall pump can be decreased. Furthermore, the cost can be reduced by omitting mounting parts such as screws used in the conventional pumps. Rotation of the laminated body such as the coil bobbin 31 to be accommodated in the pump housing can be stopped by using a frictional force between the components or by forming an engaging portion for stopping the rotation between the coil bobbin 31 and the lid 12.

According to a characteristic feature of the present invention, in the electromagnetic pump 10 having the above arrangement, a plurality (three in this embodiment) of engaging projections 50 are formed upright on the peripheral portion of the outer surface of a flange 31*b* of the coil bobbin 31 on the lid 12 side, as shown in FIGS. 1 to 4. Subsequently, as described above, the coil bobbin 31, the printed circuit board 34, and the holder 35 are sequentially stacked and accommodated in the body 11 while the lid 12 is integrally fixed to the body 11. In this case, the engaging projections 50 are used as biasing means for stably accommodating the laminated body in the body 11 while they are biased toward the bottom of the body 11, i.e., in the axial direction of the sleeve. That is, if the body 11 and the lid 12 are integrally fixed to each other while the engaging projections 50 are biased toward the bottom of the body 11 by the lid 12 in this arrangement, a portion of the flange 31*b* of the coil bobbin 31, on which the engaging projections 50 are formed, is elastically deformed, and its reaction force functions as a biasing force for biasing the laminated body toward the bottom of the body 11.

According to the arrangement of the present invention, the conventional problem, i.e., that since a leaf spring is arranged at a bottom side of the housing 11, when the laminated body such as the coil bobbin 31 is moved toward the lid 12 upon assembly, the sleeve member 15 and the like are also moved, thus disengaging part of the seal ring (arranged at a portion denoted by reference numeral 43) and degrading the sealing property, can be solved, and hence reliability as a pump can be improved. Such an effect in the present invention can be easily understood from the fact that a biasing force in the present invention is obtained from the engaging projections 50 formed on the flange 31*b* of the coil bobbin 31 on the lid 12 side, and no movement is caused inside the body 11 when the body 11 and the lid 12 are fixed to each other by caulking unlike the conventional pumps.

In addition, according to the present invention, a leaf spring used to cancel variations in size of the laminated body and the like as in the conventional pumps is not required, and the number of components can be decreased. In addition, assembly can be facilitated, and the cost can be reduced. Since the engaging projections 50 can be easily formed integrally with the coil bobbin 31, no problem is posed in terms of working process. Note that the fixing force of the laminated body in the pump housing is determined by the rigidity and deformation amount of the coil bobbin 31, and that the fixing force of the sleeve member 15 is obtained from the holding forces of the seal rings 42 and 43 urged by the magnetic cylinders 40 and 41.

The present invention is not limited to the arrangement described in the above embodiment. The shape and structure of the pump components can be arbitrarily changed and modified. In the above embodiment, the engaging projections 50 constituting the characteristic feature of the present invention are formed at three positions on the outer surface of the flange 31*b* of the coil bobbin 31 at equal angular intervals. However, the shape and number of the projections 50 can be properly modified.

As has been described above, according to the electromagnetic pump of the present invention, a pump housing is constituted by a substantially cup-like housing body and a lid for closing the opening end of the body, and pump components are simply accommodated so as to constitute a laminated body in the pump housing while a biasing force is provided to the laminated body by using engaging projections extending from the peripheral portion of the outer surface of one flange of a coil bobbin. Therefore, in spite of a simple arrangement, an arrangement, working, and the like of each component can be simplified, and moreover, assembly and the like can be facilitated, thereby providing a great practical effect when a great reduction in cost is attempted.

Especially, according to the present invention, since the pump components stacked and accommodated in the pump housing is biased by using deformation due to the engaging projections extending from the flange, on the lid side, of the oil bobbin as part of the components, the internal components are not moved when the housing body and the lid are integrally formed unlike the conventional pumps, thereby preventing disengagement of a seal ring and the like and ensuring reliability as a pump.

What is claimed is:

1. An electromagnetic pump comprising:

a cylindrical member including a magnetic cylindrical member for slidably housing a plunger;

a resin coil bobbin arranged outside said cylindrical member and having an excitation coil wound therearound;

a printed circuit board arranged outside said cylindrical member at a distance from one side surface of said resin coil bobbin;

a holder arranged outside said cylindrical member at a distance from the other side surface of said resin coil bobbin with respect to said printed circuit board; and a pump housing constituted by a cup-like housing body for accommodating the electromagnetic pump components and a lid mounted thereon so as to close an opening end of said housing body, wherein an engaging projection is formed on a peripheral portion of the surface of said coil bobbin, which opposes said lid, and the electromagnetic pump components are held while said components are biased in an axial direction of said cylindrical member by utilizing said engaging projections.

* * * * *

UNITED STATES PATENT AND TRADEMARK OFFICE

CERTIFICATE OF CORRECTION

PATENT NO. : 4,895,495

DATED : January 23, 1990

INVENTOR(S) : Takatoshi Arai

It is certified that error appears in the above-identified patent and that said Letters Patent is hereby corrected as shown below:

Col. 1, line 17, change "generaly" to --generally--;

Col. 2, line 5, insert --,-- after "Therefore";
line 6, insert --in-- before "the simple";
line 6, change "their" to --this--;

Col. 5, line 23, change "ca" to --can--;

Col. 6, line 49, change "oil" to --coil--.

Signed and Sealed this

Ninth Day of May, 1995

*Attest:*

*Attesting Officer*

BRUCE LEHMAN

*Commissioner of Patents and Trademarks*